US005757879A

United States Patent [19]

Joshi et al.

[11] Patent Number: 5,757,879

[45] Date of Patent: May 26, 1998

[54] TUNGSTEN ABSORBER FOR X-RAY MASK

[75] Inventors: Rajiv Vasant Joshi, Yorktown Heights, N.Y.; Kurt Rudolf Kimmel, Jericho, Vt.; Thomas John Licata, Lagrangeville, N.Y.; James Gardner Ryan, Newtown, Conn.

[73] Assignee: International Business Machines Corporation, Armonk, N.Y.

[21] Appl. No.: 707,808

[22] Filed: Aug. 30, 1996

Related U.S. Application Data

[63] Continuation of Ser. No. 486,219, Jun. 7, 1995, abandoned.

[51] Int. Cl.[6] ..... G21K 5/00

[52] U.S. Cl. ..... 378/35; 378/210

[58] Field of Search ..... 378/35

[56] References Cited

U.S. PATENT DOCUMENTS

| | | | |
|---|---|---|---|
| 3,654,110 | 4/1972 | Kraus . | |
| 4,724,060 | 2/1988 | Sakata et al. . | |
| 4,824,544 | 4/1989 | Mikalesen et al. . | |
| 5,043,586 | 8/1991 | Giuffre et al. . | |
| 5,188,706 | 2/1993 | Hori et al. . | |
| 5,457,006 | 10/1995 | Kerokane et al. | 378/35 |

FOREIGN PATENT DOCUMENTS

| | | |
|---|---|---|
| 0440377A2 | 8/1991 | European Pat. Off. . |
| 512296A1 | 11/1992 | European Pat. Off. . |
| 5326426 | 8/1992 | Japan . |
| 5243181 | 9/1993 | Japan . |

OTHER PUBLICATIONS

"High-resolution and high-fidelity x-ray mask structure employing embedded absorbers"; S.Y. Chou et al.; J. Vac. Science, Nov./Dec. 1988.

"EB Proximity Printer With Increased Throughput"; K. Asch et al.; IBM Technical Disclosure Bulletin; vol. 26, No. 2, Jul. 1983.

*Primary Examiner*—Craig E. Church

*Attorney, Agent, or Firm*—Whitham, Curtis, Whitham & McGinn; Alison D. Mortinger, Esq.

[57] ABSTRACT

An damascene x-ray mask comprises an oxide membrane layer having trenches formed therein defining an x-ray mask pattern. The trenches are filled with collimated, sputtered tungsten sputtered in a relatively high pressure environment. The result is a dense, low stress tungsten film completely filling the trenches. Damascene refers to the process by which the mask is formed. The mask is formed on a silicon substrate and then the substrate is etched away from the bottom side leaving substantially just the oxide layer and the collimated tungsten. The oxide layer is transparent to x-rays and the collimated tungsten layer is opaque to x-rays.

14 Claims, 3 Drawing Sheets

TUNGSTEN ABSORBER FOR X-RAY MASK

This application is a continuation of U.S. patent application Ser. No. 08/486,219, filed Jun 7, 1995, now abandoned.

DESCRIPTION

BACKGROUND OF THE INVENTION

1. Field of the Invention

The present invention generally relates to x-ray lithography masks and, more particularly, to low stress, high density, damascene tungsten x-ray masks.

2. Background Description

Semiconductor integrated circuits (ICs) are typically manufactured using lithographic techniques, either photolithographic processes which uses light to expose a photoresist through a mask or direct writing electron beam (E-beam) processes to produce the mask. The resolution of these lithographic techniques is a function of wavelength which is ultimately the limiting factor in the density of the semiconductor structures which can be formed. The trend to ever higher densities in ICs has given rise to the use of x-ray lithography, providing submicron resolutions.

Conventional x-ray masks, used in x-ray lithography, use an x-ray absorber material formed on the surface of a membrane film using a subtractive etch process. A film of x-ray absorber material is deposited on the membrane film and all unwanted areas are removed using a subtractive etch process. The portions of the absorber material remaining after the subtractive etch comprises the x-ray mask. This arrangement suffers from a variety of problems. Not the least of which is poor adhesion between the mask and the membrane film due to the small contact area. Hence, separation between the substrate and the mask is a common occurrence.

Currently, low stress gold films are used as the x-ray absorber material in x-ray masks utilizing electroplated gold. Gold has numerous drawbacks as an absorber material. It is difficult to rework and is very expensive. Since x-ray lithography is a close proximity printing process, the risk of gold contamination of the device wafer during exposure is a source of concern. Furthermore, since gold is a relatively inert metal it is difficult to etch and repair.

The material most frequently mentioned as a replacement for gold as an x-ray absorber material is tungsten. Although less expensive and reworkable, tungsten films usually exhibit high film stress, thereby causing a high degree of distortion of the mask membrane. When tungsten film stress is reduced, often the density of the film is reduced, making a less effective x-ray absorber.

S. Y. Chou et al., High-Resolution and High Fidelity X-Ray mask Structure Employing Embedded Absorbers, *J. Vac. Science*, November/December, 1988, proposes an embedded tungsten x-ray mask wherein the x-ray absorber material is actually embedded in the membrane film itself, rather than on top of the membrane. The mask consists of a single crystal membrane having patterned trenches that are filled with chemical vapor deposition (CVD) tungsten. The four main steps for forming such a mask include laying a photoresist pattern mask on the substrate, forming trenches in a Si substrate with a reactive ion etch (RIE), filling the trenches with tungsten with a CVD process, and etching back the underside of the substrate to create the membrane. The trenches are somewhat cone shaped and are about 5 μm deep, and have a top opening of 70 nm wide and a bottom opening of about 40 nm wide. The slope of the trench sidewalls are reported to be about 1.5° degrees from the vertical. This slope is important for insuring that CVD tungsten completely fills the trenches. If the sidewalls were straight, shadowing would cause voids to be created in the trenches due to tungsten adhering to the trench walls and creating a pinch-off situation before the bottom of the trench is completely filled.

SUMMARY OF THE INVENTION

It is therefore an object of the present invention to provide a method for making low stress, high density tungsten film which is effective as an x-ray absorber for x-ray masks.

It is also an object of this invention to provide a means for greater control in tungsten film deposition.

It is yet another object of the present invention to provide a damascene tungsten x-ray mask using a collimator.

According to the invention, a damascene x-ray mask comprises an oxide membrane layer having trenches formed therein defining an x-ray mask pattern. The trenches are filled with collimated, sputtered tungsten sputtered in a relatively high pressure environment. The result is a dense, low stress tungsten film completely filling the trenches.

"Damascene" refers to the process by which the mask is formed. Damascene is a term borrowed from the jewelry making art which generally refers to a process where a precious or decorative metal is inlaid on a substrate and then polished flush on the top and bottom surfaces to form a smooth surface with the inlay visible on either side. Here, damascene is used to refer to the process of inlaying collimated, sputtered tungsten into vertical trenches etched in an oxide layer deposited on the surface of a substrate. The use of a collimator eliminates shadowing problems so that the trenches are completely filled with sputtered tungsten. The back side of the substrate is then etched to remove all but a thin layer of silicon beneath the base of the tungsten filled trenches. The resultant product is an x-ray mask which allows x-rays to pass freely through the oxide membrane portion but effectively blocks those x-rays which encounter the tungsten trenches.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
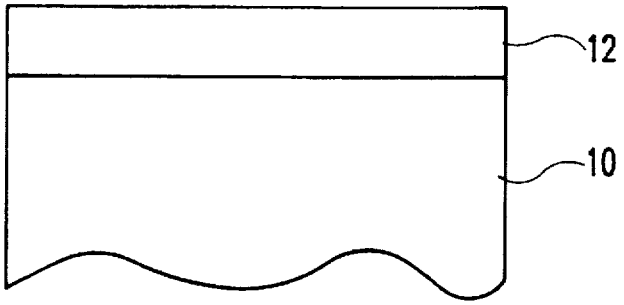
FIG. 1 is a silicon substrate having a layer of TEOS (tetraethyl orthosilicate) of a thickness equal to the thickness of the x-ray mask.

Referring now to the drawings, and more particularly to FIG. 1, there is shown silicon substrate 10 on which a TEOS oxide layer 12 is deposited. The TEOS oxide layer 12 is deposited to a thickness the same as the desired x-ray absorber material thickness. Depending on the x-ray source that will be used, the TEOS layer 12 is preferably chosen to be between 4000 to 8000 Å thick.

Figure 2:
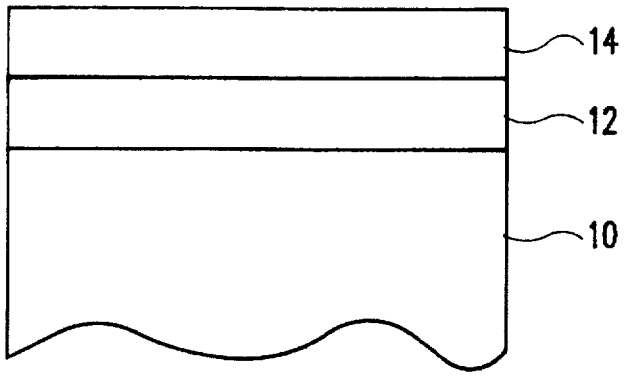
FIG. 2 is a silicon substrate having a layer of TEOS and a layer of photoresist.
Figure 3:
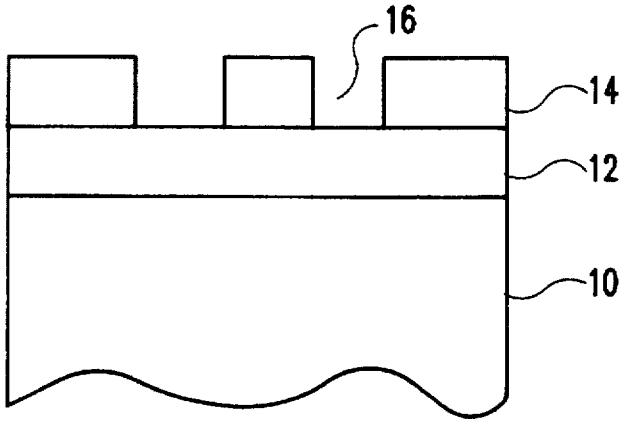
FIG. 3 is a silicon substrate having a layer of TEOS and a layer of photoresist patterned with x-ray mask trenches.
Figure 4:
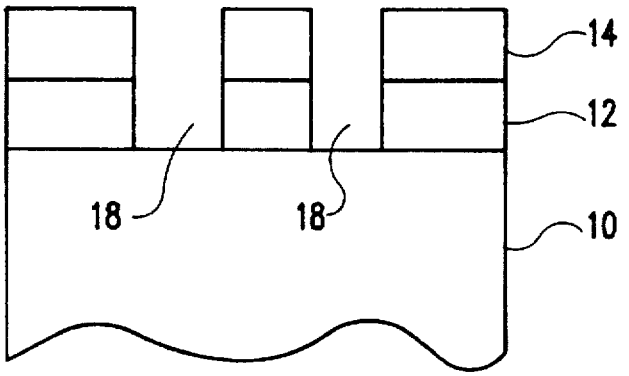
FIG. 4 is a silicon substrate having a layer of etched TEOS having trenches formed therein.

FIG. 2 shows a layer of photoresist 14 deposited on top of the TEOS layer 12. The photoresist layer 14 may be deposited in a variety of ways. However, the photoresist layer 14 is preferably deposited by a spin coating method to insure a uniform layer of photoresist material over the entire TEOS layer 12. The resist is lithographically exposed and an x-ray mask pattern 16 is developed in the photoresist layer 14, as shown in FIG. 3. A reactive ion etch (RIE) process is used to transfer the resist pattern 16 into the TEOS layer 12, as shown in FIG. 4, to form trenches 18 where the x-ray absorbing material will be deposited. The photoresist layer 14 is then stripped from the TEOS layer 12.

Figure 5:
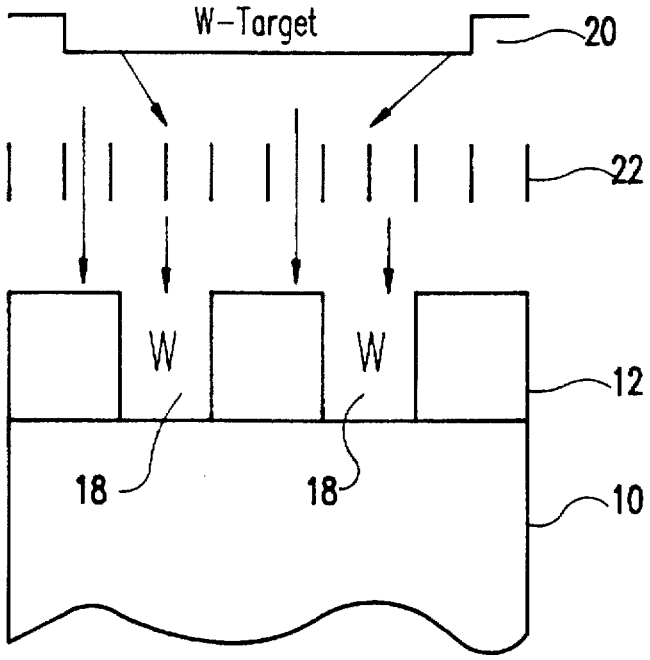
FIG. 5 is a view of the trenches being filled with collimated sputtered W.

Referring now to FIG. 5, a sputtering process is used to fill the trenches 18 with a dense, low stress tungsten (W) film. Sputtering involves bombarding a target material 20, in this case tungsten, with ions to cause the target material to be released from the target and deposit on the surfaces below. In a conventional sputtering process, the sputtered material is ejected with a wide range of angles. The wide angle of distribution of the sputtered material leads to shadowing and a loosely packed columnar structure having many voids and random, large grain patterns which would be unsuitable for x-ray mask applications. To remedy this problem a collimator 22 is placed between the target 20 and the substrate 10 to cause sputtered tungsten atoms to arrive from angles substantially normal to the floor of the trenches 18. In addition, a relatively high sputtering gas pressure (12–18 mT of Ar) is used in combination with the collimator 22 to produce a fine grain, high density, low stress film which completely fills the trenches. It is unexpected that high pressure collimation provides suitable film density and stress reduction. Normally, collimated sputtering pressures are very low and result in films having large compressive stresses. Several experiments have been conducted to evaluate collimated and uncollimated tungsten films at various pressures. The results are shown below in the Table.

STRESS AND DENSITY FOR COLLIMATED TUNGSTEN

| Pressure (mT) | Collimation | Stress (dynes/cm$^2$) | Density (%) |
|---|---|---|---|
| 0.2 | none | −3.6 e10 | 96 |
| 0.2 | 1:1 | −2.1 e10 | 99 |
| 2.0 | none | −1.9 e10 | 95 |
| 2.0 | 1:1 | −5.6 e10 | 98 |
| 6.0 | none | −6.9 e9 | 96 |
| 6.0 | 1:1 | −5.6 e8 | 98 |
| 12 | none | −3.4 e9 | 92 |
| 12 | 1:1 | −1.3 e8 | 99 |
| 18 | none | 6.9 e9 | 94 |
| 18 | 1:1 | 2.3 e9 | 98 |

For each of the pressures shown above, the collimated tungsten consistently has a lower stress factor and a higher density factor than the non-collimated tungsten. This is true even for the higher pressure examples at 12 and 18 mT.

Figure 6:
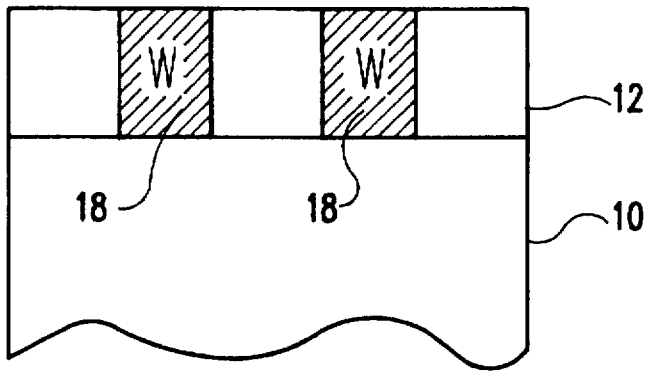
FIG. 6 is a view after any excess W on the trench plateaus is removed.

Referring now to FIG. 6, the excess tungsten is removed so that the trenches 18 are flush with the top of the TEOS layer 12. Preferably, this is done with a chemical/mechanical polishing technique.

Figure 7:
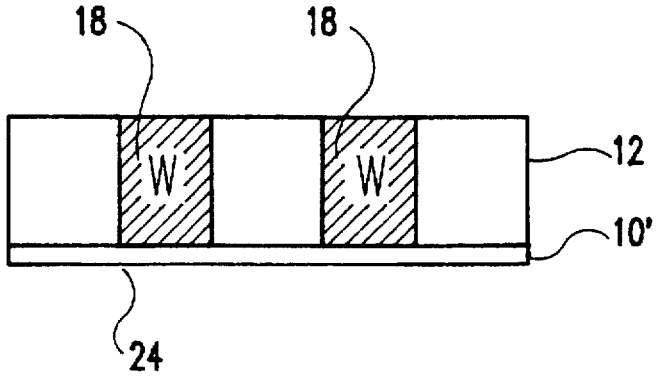
FIG. 7 is a view of the x-ray mask after the underside of the mask has been removed.

Referring now to FIG. 7, the bottom side 24 of the silicon substrate 10 is etched away to just below the bottom of the tungsten filled trenches 18. An etch stop may be applied to leave a thin layer of silicon beneath the TEOS layer 12. This silicon layer 10' may be on the order of 2 μm thick. The resultant is an x-ray mask where x-rays pass relatively unattenuated through the thin TEOS layer membrane 12 and thin silicon layer 10', but are attenuated by the tungsten (W) filled trenches 18.

Figure 8:
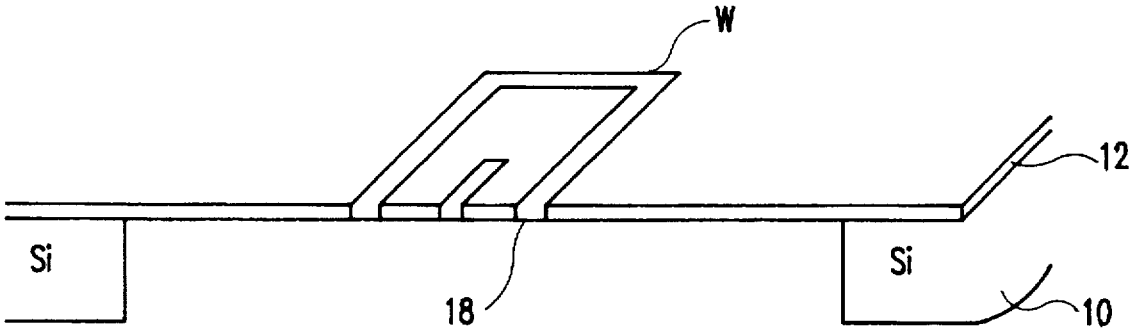
FIG. 8 is a three dimensional view of the x-ray mask according to the present invention.

FIG. 8 shows a three dimensional view of the x-ray mask created by the damascene method. In this embodiment, the entire silicon layer 10 has been etched away from under the tungsten trenches 18, leaving only the tungsten 18, suspended in the TEOS layer 12. Using this damascene method, it is also possible to produce x-ray grey level masking where parts of the trenches 10 are filled with tungsten, and other parts are filled with a less opaque material. In areas where there is a less opaque material, some impinging x-rays will be absorbed, and others passed. Alternatively, a grey level mask can be created using a single absorber material, such as tungsten, by forming the trenches 18 to various depths in the TEOS oxide layer 12. In this manner, varying thicknesses of absorber material filling the trenches will effectively provide varying degrees of x-ray transparency.

While the invention has been described in terms of a single preferred embodiment, those skilled in the art will recognize that the invention can be practiced with modification within the spirit and scope of the appended claims.

We claim:

1. A method for forming an x-ray mask using a tungsten film absorber, comprising the steps of:

depositing an oxide layer on a top side of a substrate;

forming trenches in said oxide layer defining an x-ray mask pattern;

sputtering collimated tungsten into said trenches to completely fill said trenches;

removing excess tungsten to make said trenches flush with said oxide layer;

removing said substrate starting from a bottom side of said substrate to minimize substrate thickness.

2. A method for forming an x-ray mask as recited in claim 1 wherein said step of removing leaves a layer of said substrate at most approximately 2 μm thick.

3. A method for forming an x-ray mask as recited in claim 1 wherein said step of removing is etching.

4. A method for forming an x-ray mask as recited in claim 1 wherein said sputtering step is performed at a pressure between 12 to 18 mT.

5. A method for forming an x-ray mask as recited in claim 1 wherein removing excess tungsten step is performed by polishing.

6. A method for forming an x-ray mask as recited in claim 1 wherein said step of forming trenches in said oxide layer comprises forming trenches having varying depths for realizing a grey level x-ray mask.

7. A method of forming an x-ray mask as recited in claim 1 wherein said oxide layer is deposited using a tetraethyl orthosilicate (TEOS) source.

8. A damascene tungsten absorber x-ray mask, made by the process comprising the steps of:

forming on a top side of a substrate an oxide layer, said oxide layer having trenches formed therein defining an x-ray mask pattern, said oxide layer being transparent to x-rays;

depositing a collimated tungsten film filling said trenches, said collimated tungsten film being opaque to x-rays; and removing a portion of said substrate from a bottom side.

9. A damascene tungsten absorber x-ray mask as recited in claim 8 wherein said substrate is approximately 2 μm thick after said step of removing.

10. A damascene tungsten absorber x-ray mask, as recited in claim 8 wherein said trenches are of varying depths for realizing a grey level x-ray mask.

11. A damascene tungsten absorber x-ray mask as recited in claim 8 wherein said collimated tungsten film is sputter deposited at a gas pressure of 12–18 mT.

12. A grey scale x-ray mask, comprising:

an oxide layer having a plurality of trenches formed therein defining an x-ray mask pattern, said oxide layer being transparent to x-rays;

a plurality of x-ray absorber materials of varying x-ray transparency filling various ones of said plurality of trenches.

13. A grey scale x-ray mask as recited in claim 12 wherein said oxide layer is tetraethyl orthosilicate (TEOS).

14. A grey scale x-ray mask as recited in claim 12 wherein one of said plurality of x-ray absorber materials is tungsten.

* * * * *